US005186698A

United States Patent [19]

Mason et al.

[11] Patent Number: 5,186,698

[45] Date of Patent: Feb. 16, 1993

[54] ANKLE EXERCISE SYSTEM

[75] Inventors: Bradley R. Mason, Olivenhain; Jeffrey T. Mason, Escondido, both of Calif.

[73] Assignee: Breg, Inc., Vista, Calif.

[21] Appl. No.: 717,965

[22] Filed: Jun. 20, 1991

[51] Int. Cl.[5] ..... A61H 1/02

[52] U.S. Cl. ..... 482/79; 482/92; 482/121; 128/25 R; 128/25 B

[58] Field of Search ..... 482/44, 45, 46, 51, 482/79, 80, 92, 121, 122, 124, 125, 129, 906, 907; 128/25 R, 25 B

[56] References Cited

U.S. PATENT DOCUMENTS

| | | | |
|---|---|---|---|
| 4,059,265 | 11/1977 | Wieder et al. | 482/125 |
| 4,245,839 | 1/1981 | Trent | 482/92 |
| 4,565,367 | 1/1986 | Kaiser | 482/121 |
| 4,685,671 | 8/1987 | Hagerman | 272/139 |
| 4,690,402 | 9/1987 | Basting | 482/121 |
| 4,725,057 | 2/1988 | Shifferaw | 482/121 |
| 4,948,117 | 8/1990 | Burke | 482/129 X |
| 5,100,129 | 3/1992 | Porter et al. | 482/129 |

*Primary Examiner*—Randall L. Green
*Assistant Examiner*—Dinh X. Nguyen
*Attorney, Agent, or Firm*—Rodney F. Brown

[57] ABSTRACT

A system utilizable by a patient engaged in strengthening, stretching or range of motion exercise therapy of the ankle which contains a number of interactive components combinable in any one of several different configurations to provide the patient with specific ankle exercise devices. One such device provides ankle dorsiflexion and inversion/eversion strengthening exercises performed by moving the patient's foot in various directions against the elastic resistance of an elastomeric tube while the device is anchored in a door jamb. Another device provides ankle dorsiflexion, plantarflexion and inversion/eversion strengthening by exerting the foot against resistance from the patient across a strap. Yet another device provides ankle supination/pronation, toe flexion/extension, and isometric eversion exercises by performing various movements with the toes or feet to deform a towel. The final device is for stretching and ankle range of motion exercises by placing the patient's foot on a platform and rocking the platform on curved runners in various directions.

14 Claims, 3 Drawing Sheets

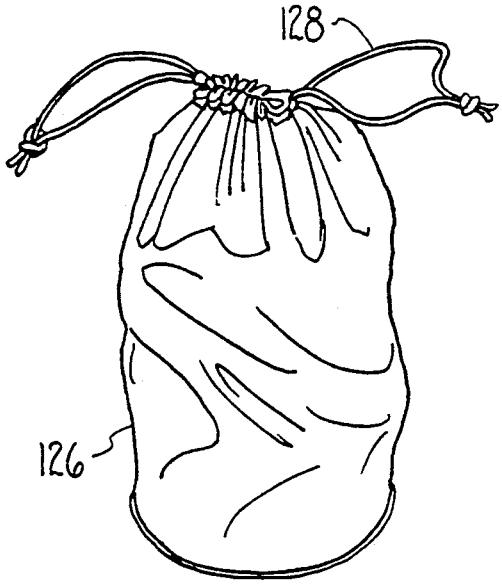
Fig. 10
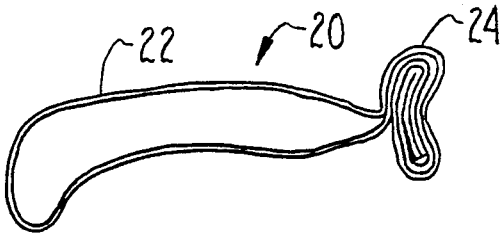
Fig. 1a
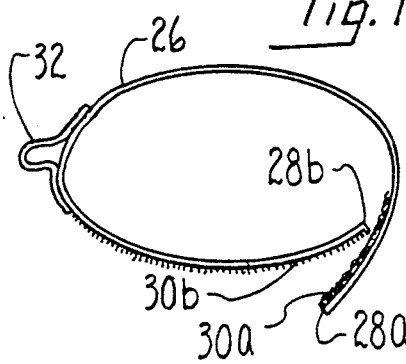
Fig. 1b
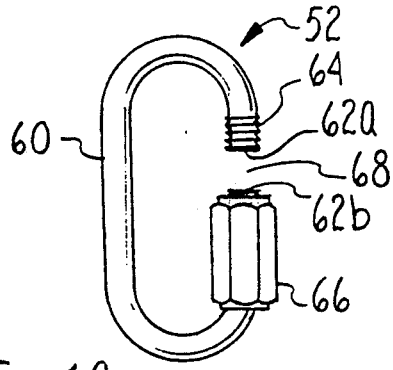
Fig. 1f
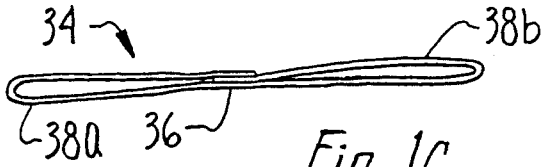
Fig. 1c
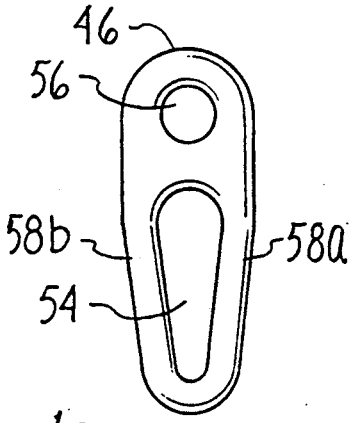
Fig. 1e
Fig. 1d
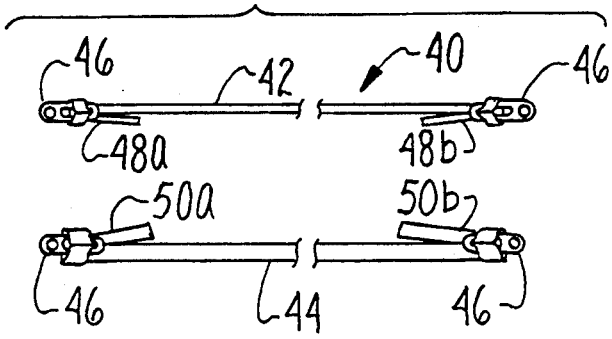

Fig. 2
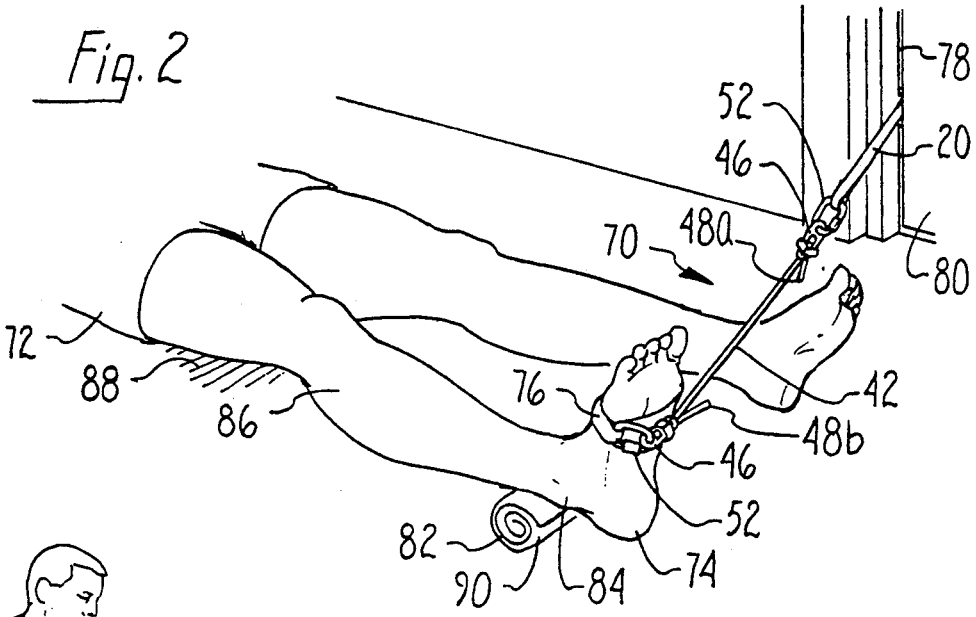
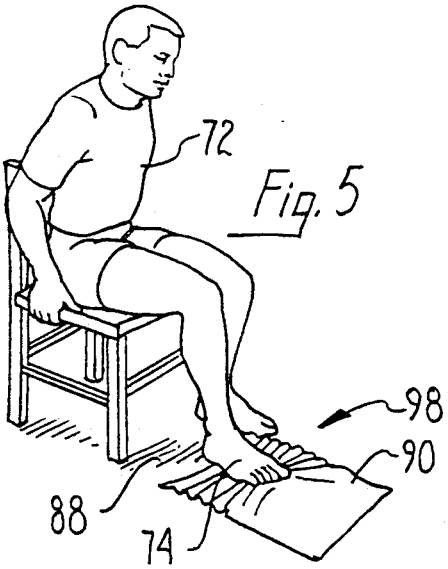
Fig. 5
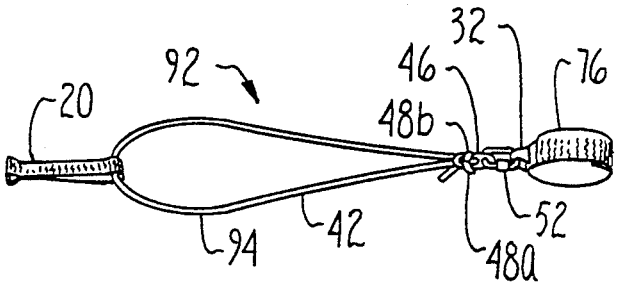
Fig. 3
Fig. 4
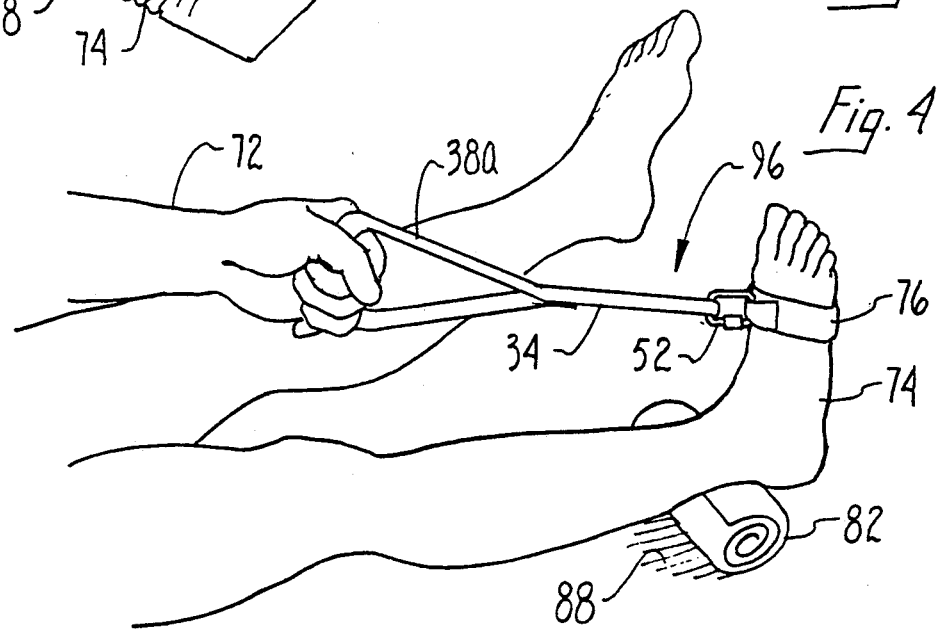

ANKLE EXERCISE SYSTEM

FIELD OF THE INVENTION

The present invention relates generally to ankle exercising. More particularly, the present invention relates to a multi-component system for therapeutically exercising the ankle. The present invention particularly, though not exclusively, relates to a multi-component system for therapeutically exercising the ankle wherein the components of the system are interchangeable to provide several different ankle exercise devices.

BACKGROUND OF THE INVENTION

Rehabilitation of the ankle joint following skeletal or soft tissue injuries is facilitated by a structured and supervised strengthening, stretching, and range of motion exercise program. Rehabilitation is most effective when the exercise program can be periodically performed by the patient on a frequent basis, even as much as several times daily. Patient participation in the exercise program is usually increased if the patient can perform the exercises within the framework of his or her daily activities without the necessity of traveling to a special facility for ongoing supervision or specialized equipment. Thus, exercise programs are desirable which can be performed in the home or the workplace with safe, simple, and inexpensive equipment once the supervising physician or therapist has adequately structured and demonstrated the exercise program to the patient.

A number of devices are known which may be utilized in the performance of ankle rehabilitation exercises. U.S. Pat. Nos. 4,635,932 to Dewees and 4,739,986 to Kucharik et al both show balance platforms on which the patient stands to kinematically exercise the ankle. Both devices are somewhat unwieldy for transporting which limits the ability of the patient to integrate an ankle exercise program using one of these devices into a daily routine, particularly when the patient is away from home. Furthermore, although the devices have safety control features, they are difficult to gauge by the patient. Thus, the patient runs the risk of aggravating the injury being rehabilitated when using the device in the absence of supervisory personnel.

U.S. Pat. No. 4,951,938 to Smith is a much more simple and transportable device for exercising the leg than the above-described devices, but it lacks any controls for protecting the safety of a patient when being used. Thus, the device has little utility in a rehabilitation exercise program.

All of the above-described devices also suffer from the fact that they are narrow in their purpose, only providing for exercise of a limited number of muscle groups related to the ankle. U.S. Pat. No. 4,685,671 to Hagerman et al is a multi-functional exercise device, but still lacks the versatility to provide the full range of ankle exercises necessary for a patient undergoing rehabilitation from an ankle injury.

As such, a need exists for an ankle exercise system which has the versatility to enable a patient to perform a broad range of ankle exercises for full rehabilitation of an injured ankle without the necessity for constant medical supervision once a physician or therapist has initially structured the exercise program. A system is further needed which is portable for ease of transportation and use in remote locations. A system is needed which is simple to assemble as well as simple and safe to use by the patient. Finally, a system is needed which fulfills the above-recited needs, yet which is relatively inexpensive to produce and maintain.

SUMMARY OF THE INVENTION

The present invention is a system utilizable by a patient engaged in strengthening, stretching or range of motion exercise therapy of the ankle as well as members of the body ancillary to the ankle. The system contains a number of components which are combinable in any one of many interchangeable configurations to provide the patient with several specific ankle exercise devices.

One such device for ankle dorsiflexion and inversion-/eversion strengthening exercises includes an elastomeric tubing segment selected from a set of tubing segments, each having a different color-coded modulus of elasticity of elongation corresponding to different required levels of effort for the performance of strengthening exercises. The device also includes a foot strap loop and a door strap loop connected to opposite ends of the tubing segment. Tubing attachment clips are provided to enable connection of the opposite ends of the tubing segment with the foot and door strap loops across loop connector clips.

The foot strap loop is designed to fit around the ball of the patient's foot and the door strap loop has a stop which holds it in place against a door jamb when the adjoining door is closed. The tubing segment extends between the two loops. Strengthening exercises are performed by moving the patient's foot in various directions against the elastic resistance of the tubing segment while the patient's foot has the foot strap loop wrapped around it and the device is anchored in a closed door by the door strap loop. A towel is further provided with the system which is rolled or folded to act as a bolster positioned under the ankle of the patient while the exercises are being performed.

As an alternative to the above-described device, the tubing segment can be looped through the door strap loop and connected at both ends by a single tubing attachment clip to provide a tubing loop interlinked with the door strap loop. The tubing attachment clip is then connected with the foot strap loop across a loop connector clip. This configuration of the ankle dorsiflexion and inversion/eversion strengthening exercise device effectively doubles the resistance of the tubing segment during the patient's exercise regimen.

A device for ankle dorsiflexion, plantarflexion and inversion/eversion strengthening exercises employs the foot strap loop of the system in conjunction with a handle strap loop. A loop connector clip is used to connect the two loops. The patient grasps the handle strap loop with his or her hand while the foot strap loop is wrapped around the patient's foot. Strengthening exercises are performed by moving or passively maintaining the patient's foot in various directions or positions against the resistance of the patient. The rolled towel is again positioned as a bolster under the ankle of the patient while the exercises are being performed.

Yet another device for ankle supination/pronation or toe flexion/extension as well as isometric eversion exercises consists of the towel by itself. The towel is spread out on a surface beneath the feet of the patient who performs various movements with the toes or feet to deform the towel, or alternatively isometrically stretches the towel by exerting both feet away from each other while pressing down on the towel.

The present ankle exercise system further includes a device for stretching and range of motion exercises. The device consists of a rocking platform positioned atop a base made up of a pair of curved parallel runners. Also provided with the device are a series of interchangeable stops having different graduated lengths. Each stop is removably attachable to the bottom of the platform at the front or back thereof to restrict the range of motion of the rocking platform in either the forward or backward direction. A slip-resistant mat is provided for placement under the base to insure a satisfactory rocking surface for the base.

Range of motion exercises are performed by placing the patient's foot on the platform and rocking the platform by moving the foot in various directions. The preselected stop affixed to the bottom of the platform and extending downwardly therefrom a predetermined distance limits the forward or backward motion of the platform as a function of the length of the stop. If a greater range of motion is desired, a shorter stop is substituted for the preselected stop, and conversely if a smaller range of motion is desired, a longer stop is substituted for the preselected stop.

A carrying bag is provided to hold all of the components of the system such that the system is rendered self-contained and portable. This enables the patient to conduct an exercise therapy program at locations remote from the supervising physician or therapist with a minimum of disruption to his or her daily activities. The system is particularly applicable to the rehabilitation of soft tissue injuries to the ankle, such as those types of ankle injuries frequently associated with athletic activities. The system is further applicable to the exercise of healthy ankles. An exercise manual may be provided with the system for containment in the carrying bag which outlines a specific exercise regimen prescribed to the patient by the supervising physician or therapist and showing the exercise procedures for the patient to follow.

The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 1*a* is a plan view of the door strap loop included in the system of the present invention;

FIG. 1*b* is a plan view of the foot strap included in the system of the present invention;

FIG. 1*c* is a plan view of the handle strap loop included in the system of the present invention;

FIG. 1*d* is a plan view of the tubing segment set included in the system of the present invention;

FIG. 1*e* is a plan view of a tubing attachment clip included in the system of the present invention;

FIG. 1*f* is a side view of a loop connector clip included in the system of the present invention;

FIG. 2 is a perspective view of an assembly of system components forming an ankle dorsiflexion and inversion/eversion strengthening exercise device as used by a patient;

FIG. 3 is another embodiment of the ankle dorsiflexion and inversion/eversion strengthening exercise device;

FIG. 4 is a perspective view of an assembly of system components forming an ankle passive dorsiflexion, plantarflexion and inversion/eversion strengthening exercise device as used by a patient;

FIG. 5 is a perspective view of an ankle supination/pronation, toe flexion/extension, and isometric eversion exercise device included in the system of the present invention as used by a patient;

FIG. 10 is a perspective view of a bag for retaining the components of the system of the present invention.

DESCRIPTION OF PREFERRED EMBODIMENTS

Figure 7:
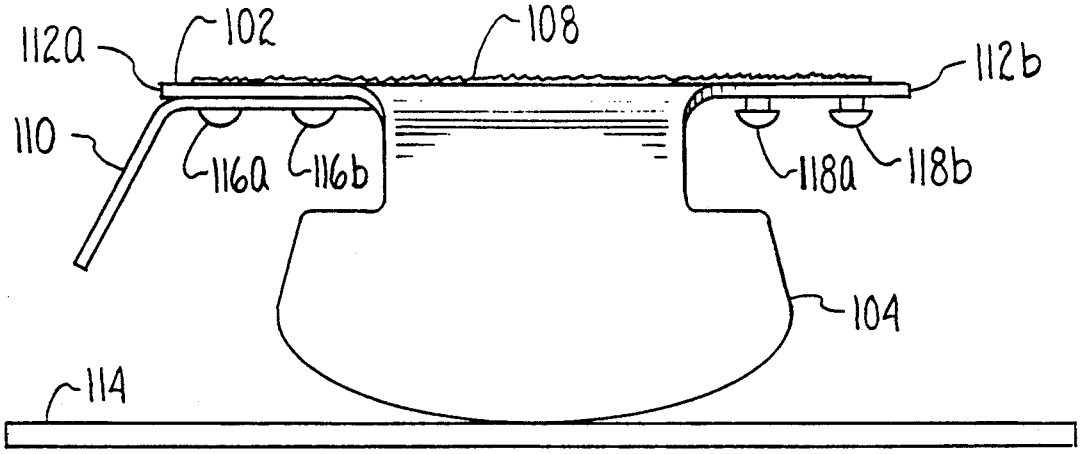
FIG. 7 is a side view of the ankle stretching and range of motion exercise device.

FIGS. 1*a*–1*f* show a plurality of interactive components utilizable in the ankle therapy system of the present invention which are combinable in different configurations and combinations to form devices for strengthening the ankle of a patient. Referring initially to FIG. 1*a*, a door strap loop designated generally as 20 is shown comprising a continuous loop 22 formed from a flexible strap which is relatively inelastic. A preferred material for loop 22 is a high-strength synthetic fabric. Appended to loop 22 is a door jamb stop 24 which is preferably formed from the same strap material as loop 22 Stop 24 is preferably integral with loop 22, formed by balling up excess strap extending from loop 22 and securing it thereto.

FIG. 1*b* shows a foot strap 26 having two opposite ends 28*a*, 28*b* which are fastenable together to form a continuous foot strap loop described hereafter with reference to subsequent figures. Fastening means, such as a pair of velcro fasteners 30*a*, 30*b* are provided at ends 28*a*, 28*b*. As with door strap loop 20, foot strap 26 is preferably formed from a flexible material which is substantially inelastic. Appended to foot strap 26 approximately in the middle thereof is a connector loop 32 comprising a section of material having similar properties as foot strap 26 and which is sewn at both ends to foot strap 26.

A handle strap loop generally designated as 34 is shown in FIG. 1*c* which is formed from a flexible, yet relatively inelastic, strap. As with door strap loop 20 and foot strap 26, a preferred material for handle strap loop 34 is a high-strength synthetic fabric. Handle strap loop 34 may be joined at a seam 36 near its midsection to form two continuous loops 38*a*, 38*b*. Loop 38*a* is sufficiently sized to enable gripping by the hand of the patient.

A set of elastomeric tubing segments designated generally as 40 are shown in FIG. 1*d*. Set 40 comprises two tubing segments 42, 44 and tubing attachment clips 46 attached to opposite ends 48*a*, 48*b* of segment 42 and opposite ends 50*a*, 50*b* of segment 44. Tubing segments 42, 44 are flexible and sufficiently elastic to enable substantial stretching thereof under a leg force provided by the patient. Each tubing segment 42, 44 has a different modulus of elasticity of elongation corresponding to different required levels of effort for stretching the tubing segment. Tubing segments 42, 44 may further have different colors to provide rapid color-coded identification of the their different moduli of elasticity.

FIGS. 1*e* and 1*f* show tubing attachment clip 46 and a loop connector clip 52, respectively in greater detail. Tubing attachment clip 46 is a unitary planar member having two bores 54, 56 formed therethrough. Clip 46 is preferably fabricated from a rigid plastic material. Wedge-shaped bore 54 is shaped to receive and fasten an end of a tubing segment thereto, such as 48*a*. As shown in FIG. 1*d*, end 48*a* of tubing segment 42 is removably fastened to tubing attachment clip 46 by looping it around opposite sides 58*a*, 58*b* of bore 54 and pulling end 48*a* taut. Circular bore 56 is shaped to receive loop connector clip 52 which can be removably secured thereto in a manner described hereafter.

Loop connector clip 52 is shown in an open position in FIG. 1*f*. Clip 52 has a c-shaped member 60 having male threads at each end 62*a*, 62*b* (Only threads 64 are shown.) A hexagonal nut 66 having internal female threads compatible with male threads 64 is threaded onto end 62*b* of member 60 to maintain a gap 68 in member 60. Clip 52 is preferably fabricated from a rigid material. If it is desired to convert clip 52 to a closed position and thereby secure loop connector clip 52 to a tubing attachment clip 46 or a loop, such as connector loop 32, clip 46 or loop 32 is looped through gap 68 and over member 60. Nut 66 is then threaded onto threads 64 of end 62*a* to close gap 68 in member 60 and secure clip 46 or loop 32 therein.

As shown in FIGS. 2–4 various combinations of the components shown in FIGS. 1*a*–1*f* are possible to assemble strengthening exercise devices. Referring to FIG. 2, an ankle dorsiflexion and inversion/eversion strengthening exercise device designated generally as 70 is shown in use by the patient 72. Device 70 comprises an elastomeric tubing segment, such as 42 preselected from set 40 according to the desired level of exercise, as well as foot strap 26 and door strap loop 20 connected to opposite ends 48*a*, 48*b* of tubing segment 42 by tubing attachment clips 46 and loop connector clips 52. Foot strap 26 is fastened around the ball of patient's foot 74 to form foot strap loop 76 and door strap loop 20 is held in place against a door jamb 78 by closed door 80 with tubing segment 42 extending between loops 20, 76.

Stop 24 and loop 22 are sized such that when loop 22 is positioned in door jamb 78, door so may be closed without interference from loop 22. However, with stop 24 positioned on one side of closed door 80 and a portion of loop 22 extending from the other side of closed door 80, stop 24 is sufficiently large to resist being drawn between closed door 80 and jamb 78 when a force is applied to the portion of loop 22 away from closed door 80.

In use, a bolster 82 is further provided with device 70 which is positioned as a support beneath the ankle 84 of the patient while the patient's leg 86 is extended on a flat surface 88 such as a floor. Bolster is formed from a folded or rolled up inelastically deformable sheet 90, such as a conventional terry cloth towel. Strengthening exercises are performed by moving the patient's foot 74 against the elastic resistance of tubing segment 42 Outward turning of the foot 74 provides eversion strengthening while inward turning of the foot 74 provides inversion strengthening. If the patient 72 is aligned perpendicular to door 80, rather than parallel as shown, pulling the foot 74 back provides dorsiflexion strengthening. Simultaneous pulling of the foot 74 back and out or back and in provides dorsiflexion/eversion or dorsiflexion/inversion strengthening respectively.

FIG. 3 shows an alternative ankle dorsiflexion and inversion/eversion strengthening exercise device designated generally as 92 wherein tubing segment 42 is looped through the door strap loop 20 and connected at both ends 48*a*, 48*b* by a single tubing attachment clip 46 to provide a tubing loop 94 interlinked with door strap loop 20. Tubing attachment clip 46 is connected with foot strap loop 76 across connector loop 32 and loop connector clip 52. Device 92 doubles the resistance afforded by tubing segment 42 in comparison to device 90.

FIG. 4 shows an ankle dorsiflexion, plantarflexion and inversion/eversion strengthening exercise device designated generally as 96 which employs foot strap loop 76 and handle strap loop 34 connected by loop connector clip 52. When using device 96 for plantarflexion strengthening exercise, the patient 72 sits on flat surface 88, rests the ankle 84 on bolster 82 and grasps loop 38*a*, while extending the patient's foot 74 forward against resistance supplied by the patient 72. Plantarflexion/inversion strengthening exercise is provided by extending foot 74 forward and in, while plantarflexion-/eversion strengthening exercise is provided by extending foot 74 forward and out. Passive dorsiflexion exercise is provided by the patient 72 statically pulling handle strap loop 34 while maintaining foot 74 pointed straight up.

Sheet 90 may be spread out on surface 88 as shown in FIG. 5 to provide an ankle supination/pronation, toe flexion/extension, and isometric eversion exercise device which is designated generally as 98. For toe flexion exercise, patient 72 is seated and deforms sheet 90 toward the patient 72 using the toes as shown in FIG. 5. For toe extension, the toes are conversely used to respread deformed sheet 90 on surface 88. Isometric eversion is performed by urging both feet of patient 72 away from each other while simultaneously pressing down on sheet 90 against surface 88 with both feet. Supination is performed by deforming sheet 90 with a sweeping motion of the foot 74 toward the patient 72, while pronation is performed by deforming sheet 90 with a sweeping motion of the foot 74 away from the patient 72.

Figure 6:
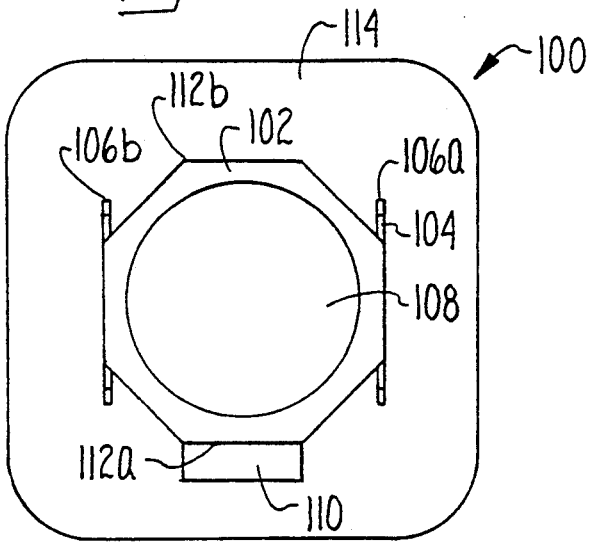
FIG. 6 is a plan view of an assembly of components forming an ankle stretching and range of motion exercise device included in the system of the present invention.

An ankle stretching and range of motion exercise device is included in the present system which is shown in FIG. 6 and generally designated as 100. Device comprises a rocking platform 102 having a base 104 positioned therebelow. Base 104 is a pair of curved parallel runners 106*a*, 106*b*. Platform 102 is sized for patient 72 to place the sole 107 of patient's foot 74 thereon and has a friction pad 108 on its top surface to receive sole 107. Device 100 also has an interchangeable platform stop 110 removably attachable to the bottom of platform 102 at the front 112*a* or back 112*b* thereof to restrict the range of motion of platform 102 (and correspondingly the ankle 84) in either the forward or backward direction as desired. A slip-resistant mat 114 is provided for placement under base 104 to insure satisfactory performance of device 100 when base 104 is positioned on a flat planar rocking surface 113 such as a floor or the ground. Mat 114 is preferably made from an elastomeric material which has a high coefficient of friction with base 104 and the rocking surface 113 shown in FIG. 9.

FIG. 7 shows means for removably attaching stop 110 to the bottom of platform 102 which comprises two pairs of rivets 116*a*, 116*b* and 118*a*, 118*b* extending from the bottom of platform 102, one pair 116*a*, 116*b* at the front 112*a* and one pair 118*a*, 118*b* at the back 112*b*. As shown, stop 110 is positioned on rivets 116*a*, 116*b* at the front 112*a* of platform 102, but it is apparent that stop 110 is interchangeably positionable on rivets 118*a*, 118*b* at the back 112*b* of platform 102.

Figure 8:
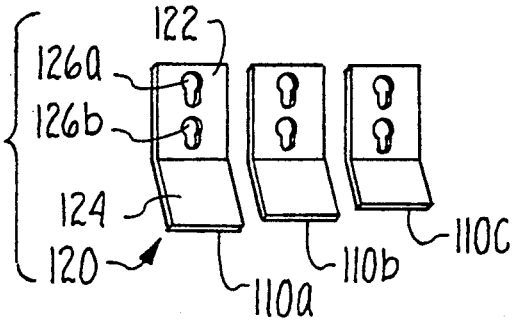
FIG. 8 is a perspective view of a series of stops used in the ankle stretching and range of motion exercise device.

A set of platform stops 120 comprising a plurality of interchangeable stops 110*a*, 110*b*, 110*c* as shown in FIG. 8 is provided with device 100. Each stop has an attachment face 112 and an extension face 124 forming an obtuse angle between each other. Attachment face 122 has a pair of slits 126*a*, 126*b* formed therein to removably attach to rivets 116*a*, 116*b* or 118*a*, 118*b* in a manner known to one skilled in the art. Extension faces 124 of stops 110*a*, 110*b*, 110*c* have graduated extension lengths to enable differing ranges of motion for ankle 84. Platform 102, base 104 and stops 110 are preferably fabricated from a strong rigid material such as sheet metal.

Figure 9:
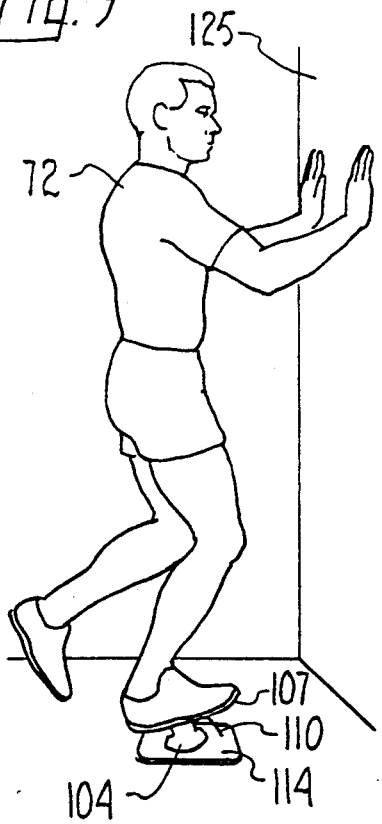
FIG. 9 is a perspective view of the ankle stretching and range of motion exercise device as used by a patient.

Referring to FIG. 9, stretching exercises are performed by placing the sole 107 of patient's foot 74 on platform 102 while patient 72 is standing, and rolling backward or forward on base 104 while stabilizing against a wall 125. Rolling forward with stop 110 positioned at the front 112*a* of platform 102 to restrict the range of forward roll provides ancillary soleus stretching. Rolling backward with stop 110 positioned at the back 112*b* of platform 102 to restrict the range of backward roll provides ancillary calf stretching.

Ankle range of motion exercise is performed with the patient 72 sitting. By rocking platform 102 backward and forward, while a preselected stop 110 is positioned at front 112*a* or back 112*b*, or at both front and back simultaneously, to restrict the range of ankle motion and prevent reinjury or aggravation of an existing injury, dorsiflexion and plantarflexion range of motion exercise is provided. By orienting platform 102 at an angle of about 45° to the foot 74 in either direction, inversion and eversion/plantarflexion and dorsiflexion exercises can be performed by rocking the foot 74 backward and forward in correspondence with the orientation of platform 102.

A set of stops 120 is preferably provided which has a longest extending stop enabling a 0° range of motion from the horizontal for severely damaged ankles and which has a shortest extending stop enabling a range of motion through 50° from the horizontal for nearly fully rehabilitated ankles. Intermediate stops can be provided at 10° increments. It is further understood that device 100 can be utilized to perform the exercises recited above without any stops attached thereto for healthy ankles.

A carrying bag 126 is shown in FIG. 10 which is provided to hold the disassembled components of the system. Bag 126 is preferably fabricated from a strong lightweight material such as a synthetic cloth and is provided with a drawstring 128 to retain its contents.

While the particular Ankle Exercise Kit as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. An ankle exercise kit having a plurality of interactive components combination in a plurality of configurations to form a plurality of means for strengthening an ankle of a user, said ankle exercise kit comprising:

a plurality of elastomeric tubing segments, each segment having a different modulus of elasticity of elongation and having a first end and a second end;

a door strap loop having a stop appended thereto for fixably positioning said loop on one side of a closed door when said stop is positioned on an opposite side of the closed door, wherein said door strap loop and said stop consist essentially of a continuous length of strap having two ends joined together, and further wherein said stop is a plurality of strap overlaps;

a foot strap loop positionable around a foot on a same leg as the ankle of the user;

a first releasable loop engagement means for engaging said foot strap loop, wherein said first releasable loop engagement means comprises a curved member dissociated from said tubing segment and having two ends, an opening therebetween, and a closure releasably engagable with said two ends of said first releasable loop engagement means to selectively close said opening and form a closed loop releasable engagable with said foot strap loop;

a releasable tubing attachment means for joining said first and second ends of said tubing segment to form a tubing loop and for attaching said tubing loop to said first releasable loop engagement means, thereby forming a dorsiflexion strengthening means, wherein said tubing loop and said door strap loop are interlinkably positionable through one another, and further wherein said releasable tubing attachment means comprises a body having two bores formed therethrough, said first and second ends of said tubing segment joinable through said first bore, and said closed loop of said releasable loop engagement means releasably engagable with said second bore.

2. An ankle exercise kit as recited in claim 1 further comprising a handle strap loop graspable by a hand of the user and a second releasable loop engagement means for engaging said handle strap loop and said foot strap loop, thereby forming a plantarflexion strengthening means, wherein said second releasable loop engagement means comprises a curved member having two ends, an opening therebetween, and a closure releasably engagable with said two ends to selectively close said opening and form a closed loop simultaneously and releasably engagable with said handle strap loop and said foot strap loop.

3. An ankle exercise kit as recited in claim 2 further comprising a sheet compactible into an ankle bolster positionable under the ankle when exercising with said plantarflexion or dorsiflexion exercise means.

4. An ankle exercise kit as recited in claim 3 wherein said sheet is substantially inelastically deformable and is further extendable for deformation by the foot of a user, thereby forming a toe flexion or extension means.

5. An ankle exercise kit as recited in claim 1 wherein said curved member is substantially c-shaped and said closure has two ends, further wherein said first end of said closure is rotatably affixed to said first end of said curved member and a second end of said closure is removably and threadably affixed to said second end of said curved member.

6. An ankle exercise kit as recited in claim 1 wherein said first releasable loop engagement means is usable as said second releasable loop engagement means when released from said tubing attachment means.

7. An ankle exercise kit as recited in claim 1 wherein each of said tubing segments is a different color associated with a given modulus of elasticity of elongation.

8. An ankle exercise kit as recited in claim 1 wherein said foot strap loop is formed from a foot strap having two ends releasably fastened to each other.

9. An ankle exercise kit having a plurality of interactive components combinable in a plurality of configurations to form a plurality of means for exercising an ankle of a user, said ankle exercise kit comprising:

a plurality of elastomeric tubing segments, each segment having a different modulus of elasticity of elongation and having a first end and a second end;

a door strap loop having a stop appended thereto for fixably positioning said loop on one side of a closed door when said stop is positioned on an opposite side of the closed door, wherein said door strap loop and said stop consist essentially of a continuous length of strap having two ends joined together, and further wherein said stop is a plurality of strap overlaps;

a foot strap loop positionable around a foot on a same leg as the ankle of the user;

a first releasable loop engagement means for engaging said foot strap loop, wherein said first releasable loop engagement means comprises a curved member dissociated from said tubing segment and having two ends, an opening therebetween, and a closure releasably engagable with said two ends to said first releasible loop engagement means to selectively close said opening and form a closed loop releasably engagable with said foot strap loop;

a first releasable tubing attachment means for releasably attachment to said first end of said tubing segment and to said first releasable loop engagement means, thereby connecting said first end of said tubing segment to said foot strap, wherein said first relesable tubing attachment means comprises a body having two bores formed therethrough, said first end of said tubing segment attachable through said first bore, and said closed loop of said releasable loop engagement means releasably attachable through said second bore;

a second releasable loop engagement means for engaging said door strap loop, wherein said second releasable loop engagement means comprises a curved member dissociated from said tubing segment and having two ends, an opening therebetween, and a closure releasably engagable with said two ends to selectively close said opening and form a closed loop releasably engagable with said door strap loop; and a second releasable tubing attachment means for releasable attachment to said second end of said tubing segment and to said second releasable loop engagement means, thereby connecting said first end of said tubing segment to said door strap and forming a dorsiflexion strengthening means, wherein said second releasable tubing attachment means comprises a body having two bores formed therethrough, said second end of said tubing segment attachable through said first bore, and said closed loop of said second releasable loop engagement means releasably attachable through said second bore.

10. An ankle exercise kit as recited in claim 9 further comprising a handle strap loop graspable by a hand of the user and a third releasable loop engagement means for engaging said handle strap loop and attachable to said foot strap loop, thereby forming a plantarflexion strengthening means.

11. An ankle exercise kit as recited in claim 10 further comprising a sheet compactible into an ankle bolster positionable under the ankle when exercising with said plantarflexion or dorsiflexion exercise means.

12. An ankle exercise kit as recited in claim 11, wherein said sheet is substantially inelastically deformable and is further extendable for deformation by the foot of a user, thereby forming a toe flexion or extension means.

13. An ankle exercise kit as recited in claim 9 wherein said first releasable loop engagement means is usable as third releasable loop engagement means when released from said first releasable tubing attachment means.

14. An ankle exercise kit as recited in claim 9 wherein said foot strap loop is formed from a foot strap having two ends releasably fastened to each other.

* * * * *